US010011933B2

(12) United States Patent
Liao

(10) Patent No.: US 10,011,933 B2
(45) Date of Patent: Jul. 3, 2018

(54) ENERGY-SAVING DYEING MACHINE

(71) Applicant: TAI SU ENERGY TECHNOLOGY CO., LTD., Taoyuan (TW)

(72) Inventor: Chiu-Huei Liao, Taoyuan (TW)

(73) Assignee: Tai Su Energy Technology Co., Ltd., Taoyuan (TW)

( * ) Notice: Subject to any disclaimer, the term of this patent is extended or adjusted under 35 U.S.C. 154(b) by 348 days.

(21) Appl. No.: 15/049,197

(22) Filed: Feb. 22, 2016

(65) Prior Publication Data

US 2017/0241057 A1 Aug. 24, 2017

(51) Int. Cl.

| | |
|---|---|
| ***D06B 23/22*** | (2006.01) |
| ***D06B 3/22*** | (2006.01) |
| ***D06B 3/34*** | (2006.01) |

(52) U.S. Cl.

CPC ..... *D06B 23/22* (2013.01); *D06B 3/22* (2013.01); *D06B 3/34* (2013.01); *D06B 2700/095* (2013.01)

(58) Field of Classification Search

None

See application file for complete search history.

(56) References Cited

U.S. PATENT DOCUMENTS

2009/0013479 A1* 1/2009 Shimizu ..... D06B 3/28 8/159

* cited by examiner

*Primary Examiner* — Jason Ko

(74) *Attorney, Agent, or Firm* — Rosenberg, Klein & Lee

(57) ABSTRACT

An energy-saving dyeing machine includes a body, a liquid dyes supply device, a liquid dyes heating device having a direct-heating heat exchanger, and a cooling unit connecting to the direct-heating heat exchanger by a series connection. When heating up the liquid dyes, the liquid dyes enters the direct-heating heat exchanger from the liquid dyes supply device via a supply tube, saving several heating procedures and unnecessary energy wastes. Additionally, an outer wall is surrounding the body to form a surrounding space for the heated exhaust gas from the direct-heating heat exchanger to enter and reheat the liquid dyes in the body again, making a better use of the heat energy.

3 Claims, 6 Drawing Sheets

ENERGY-SAVING DYEING MACHINE

BACKGROUND OF THE INVENTION

1. Field of the Invention

The present invention relates to a dyeing machine, particularly to one that has a direct-heating heat exchanger to heat up liquid dyes and further heats up the liquid dyes in a body thereof by the heated exhaust gas in order to make a better use of the heat energy and reduce unnecessary wastes.

2. Description of the Related Art

A conventional dyeing machine has structures as shown in FIG. 1, mainly including a body (110), a liquid dye supply device (120), and a guiding tube (140). The bodying has a head portion (111) with a rolling reel (113) and a nozzle (114), and a storage tank (112). The liquid dye supply device (120) sucks in liquid dyes by a main pump (121) and a dosing pump (123) from a dosing tank (122) to flow through a heat exchanger (130) via a linking tube (124) to the nozzle (114). The guiding tube (140) links the nozzle (114) to the rear of the body (110), forming a routine for a piece of fabric (141) to go through a circulation dipping.

Furthermore, the heat exchanger (130) has an inlet for steams (131), an entry for cooled water (132), an exit for cooled water (133), an outlet for sewage water (134), and a manual discharging outlet (135), so as to conduct heat exchange by steams (131) produced by a boiler with the liquid dyes. The boiler has fuels to produce heat and steams to be delivered to the heat exchanger (130) for heat exchange; in the process, the heat energy produced by the fuels have to go through several converting and delivery process before conducting heat exchanges, among which there are unnecessary wastes of heat energies; for example, the heat energies lost in conversion and steams loss in the delivery process.

In order to improve the unnecessary wastes in heat energies in the dyeing process, a direct-heating heat exchanger is developed. It has fuels to produce heated gas and directly heats up liquid dyes thereby, saving the delivery and conversion process in the conventional dyeing machine. However, after conducting the direct heating, the exhaust gas is discharged immediately, which becomes another waste in the dyeing process and therefore leaves some room for improvements in the field.

SUMMARY OF THE INVENTION

It is a primary object of the present invention to provide an energy-saving dyeing machine that has a direct-heating heat exchanger to heat up liquid dyes to reduce unnecessary energy wastes in the prior art.

Another object of the present invention is to provide an energy-saving dyeing machine that reapplies the heated exhaust gas to make a better use of the hear energy in the heating process.

In order to achieve the objects above, the present invention comprises a body having an entering port for liquid dyes arranged aside, connecting to an entering tube, and an exiting port for liquid dyes arranged at the other side, connecting to an exiting tube for liquid dyes circulation; a liquid dyes supply device arranged outside said body, including a pump for pressuring, an outlet connecting to a supply tube, and an inlet connecting to the exiting tube; a liquid dyes heating device arranged outside the body near the liquid dyes supply device, including a direct-heating heat exchanger to heat up liquid dyes, the direct-heating heat exchanger including an inner room having a heating room therein and an inner entry arranged aside, an intermediate room surrounding said inner room, defining a heat exchanging room with a first entry connecting to the supply tube and a first exit connecting to a series connected pipeline for discharging heated liquid dyes, an outer room surrounding the intermediate room, defining a discharging room with a exhaust gas outlet and including a plurality of connecting holes connecting through the heating room and an outer entry arranged corresponding to the inner entry, and a heating unit arranged at the outer entry to send in fuels into the heating room; and a cooling unit arranged outside the body near the liquid dyes heating device, including a heat exchanger to cool down liquid dyes, the heat exchanger having an entering port for liquid dyes connecting to an entry valve and a cooled water supply tube, an exiting port for liquid dyes connecting to an exit valve for discharging cooled water, a second entry connecting to the series connected pipeline, and a second exit connecting to the entering tube;

Whereby when heating up liquid dyes, the exit valve is closed and liquid dyes enter the direct-heating heat exchanger from the liquid dyes supply device via the supply tube for heating, then flow through the series connected pipeline and the cooling unit without cooling and flow into the body via the entering tube; while cooling down liquid dyes, the exit valve is opened and liquid dyes enter the direct-heating heat exchanger from the liquid dyes supply device via the supply tube without heating, then flow through the series connected pipeline into the heat exchanger for cooling, and flow into the body via the entering tube.

With structures disclosed above, the body includes an outer wall to define a surrounding space for heating. The surrounding space has an intake port arranged aside and an exit port arranged at the other side, and the exhaust gas outlet of the direct-heating heat exchanger has an exhaust gas duct connecting the intake port of the surrounding space thereby the heated exhaust gas is able to enter the surrounding space to heat up liquid dyes in the body for a second time, making a better use of the heat energy. The body further includes a head portion with a rolling reel and a nozzle connecting to the entering port for liquid dyes, a storage tank, and a guiding tube linking the nozzle to a rear section of the body for circulation dipping.

As stated above, the present invention has the direct-heating heat exchanger to heat up liquid dyes by the heated gas, saving several heating procedures and unnecessary energy wastes in a conventional dyeing machine. In addition, the present invention further uses the heated exhaust gas reheat the liquid dyes in the body to make a better use of the heat energy.

DETAILED DESCRIPTION OF THE PREFERRED EMBODIMENT

Figure 1:
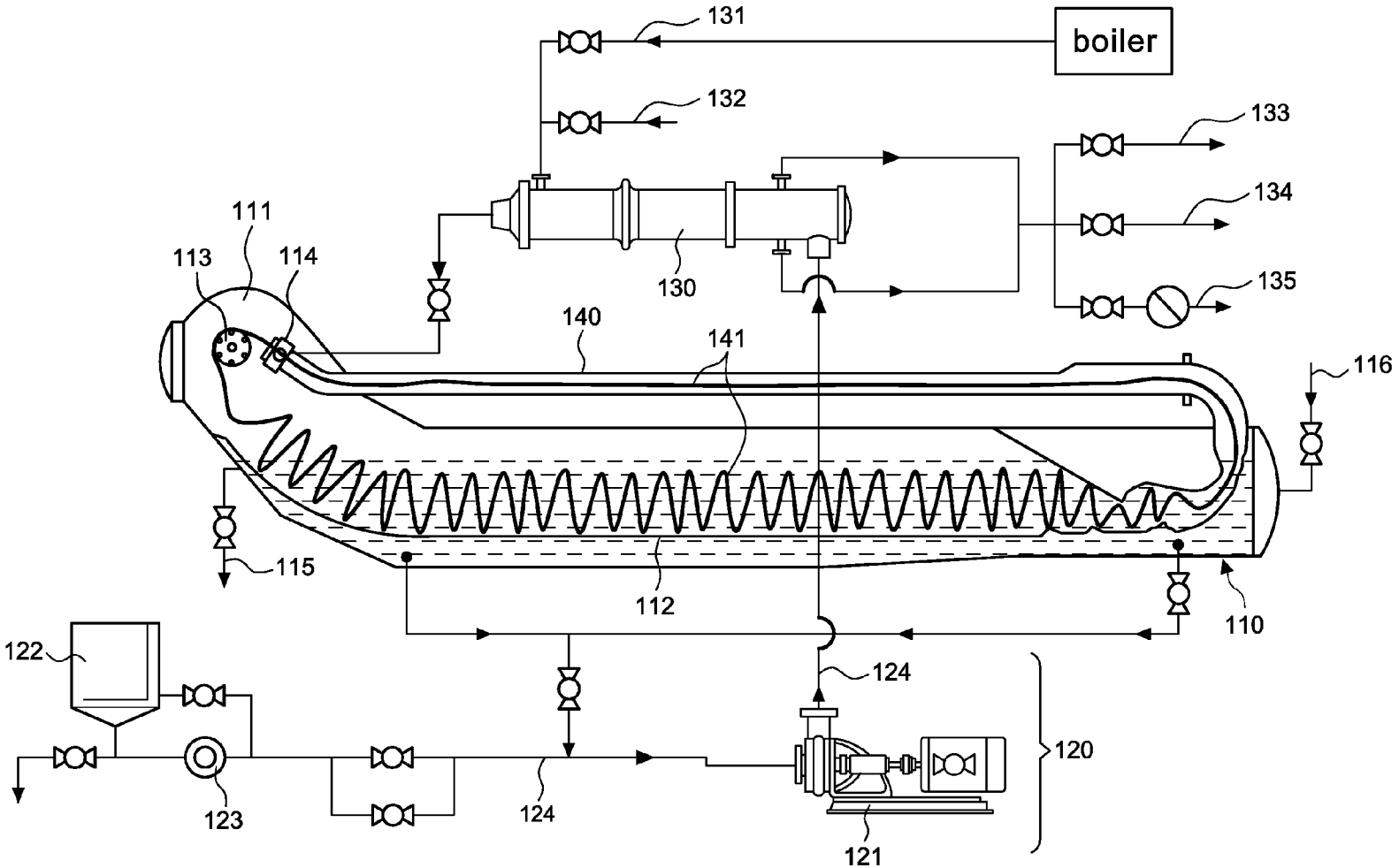
FIG.1 PRIOR ART
FIG. 1 is a schematic diagram illustrating structures of a conventional dyeing machine.
Figure 2:
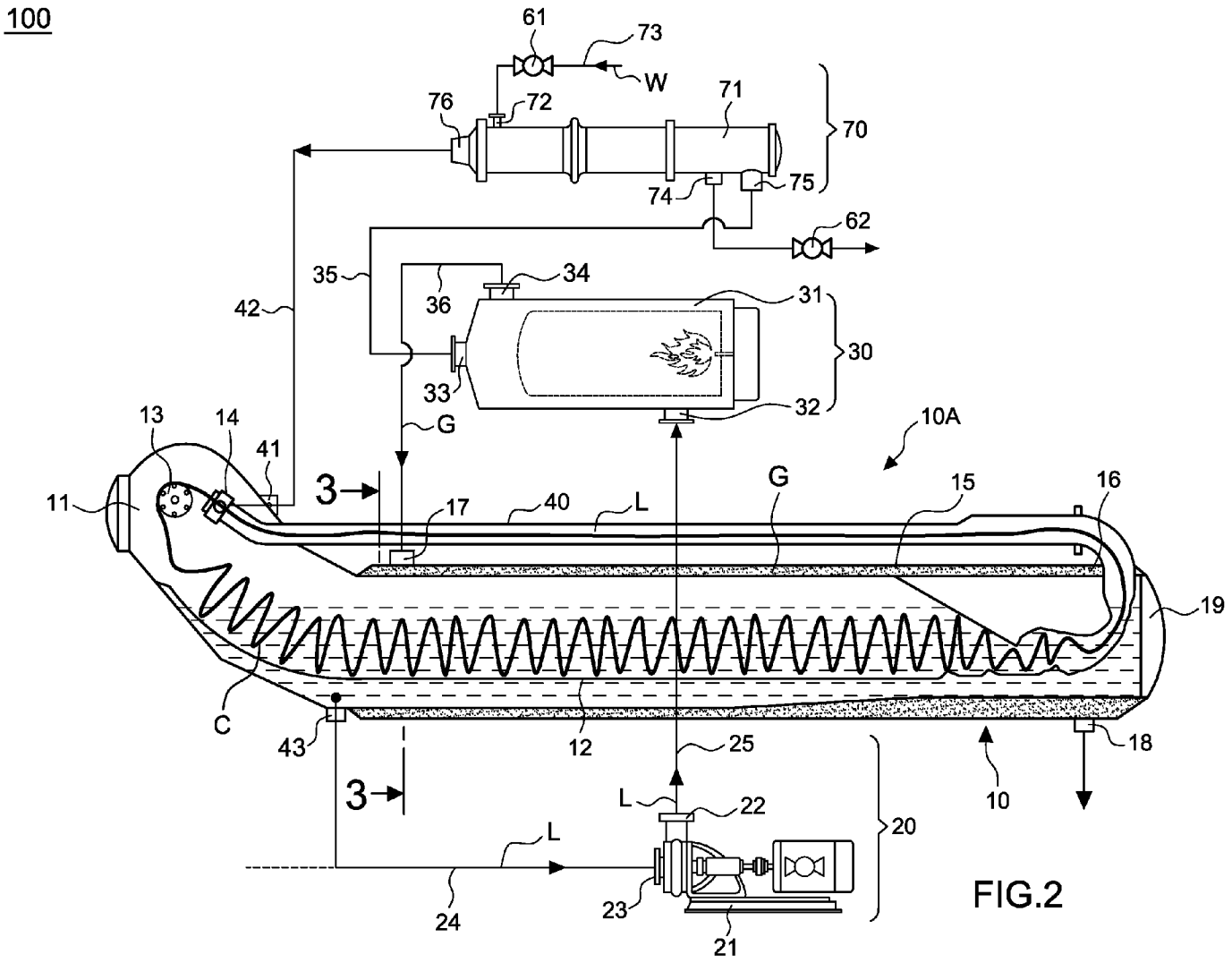
FIG. 2 is a schematic diagram illustrating structures of the present invention as a horizontal dyeing machine.

Referring to FIG. 2, in an applicable embodiment, a horizontal energy-saving dyeing machine 100 mainly includes a body 10, a guiding tube 40, a liquid dyes supply device 20, a liquid dyes heating device 30, and a cooling unit 70. In this embodiment, the body 10 is horizontally arranged but it is not limited to such application. It can be vertically arranged as well.

The body 10 includes a head portion 11, a storage tank 12, an entering port for liquid dyes 41 arranged above, connecting to an entering tube 42, and an exiting port for liquid dyes 43 arranged below, connecting to an exiting tube 24. The head portion 11 further includes a rolling reel 13 and a nozzle 14 connecting to the entering port for liquid dyes 41. The guiding tube 40 links the nozzle 14 to a rear section 19 of the body 10 for circulation dipping.

The features of the present invention are described as following. The body 10 further includes an outer wall 15 to define a surrounding space 16 for heating, and the surrounding space 16 has an intake port 17 arranged aside and an exit port 18 arranged at the other side. The liquid dyes supply device 20 is arranged outside the body 10, including a pump 21 for pressuring liquid dyes L, an outlet 22 connecting to a supply tube 25, and an inlet 23 connecting to the exiting tube 24. The liquid dyes heating device 30 is arranged outside the body 10, including a direct-heating heat exchanger 31 to heat up liquid dyes L, and an exhaust gas outlet 34 connecting to an exhaust gas duct 36 for discharging heated exhaust gas G. The direct-heating heat exchanger 31 includes a first entry 32 connecting to the supply tube 25 and a first exit 33 connecting to a series connected pipeline 35 for discharging heated liquid dyes L. The exhaust gas duct 36 further connects to the intake port 17 of the surrounding space 16, thereby the heated exhaust gas G is able to enter the surrounding space 16 to heat up the liquid dyes L in the body 10.

The cooling unit 70 is arranged outside the body 10 near the liquid dyes heating device 30, including a heat exchanger 71 to cool down the liquid dyes L. The heat exchanger 71 has an entering port for liquid dyes 72 connecting to an entry valve 61 and a cooled water supply tube 73, an exiting port for liquid dyes 74 connecting to an exit valve 62 for discharging cooled water W, a second entry 75 connecting to the series connected pipeline 35, and a second exit 76 connecting to the entering tube 42.

Figure 3:
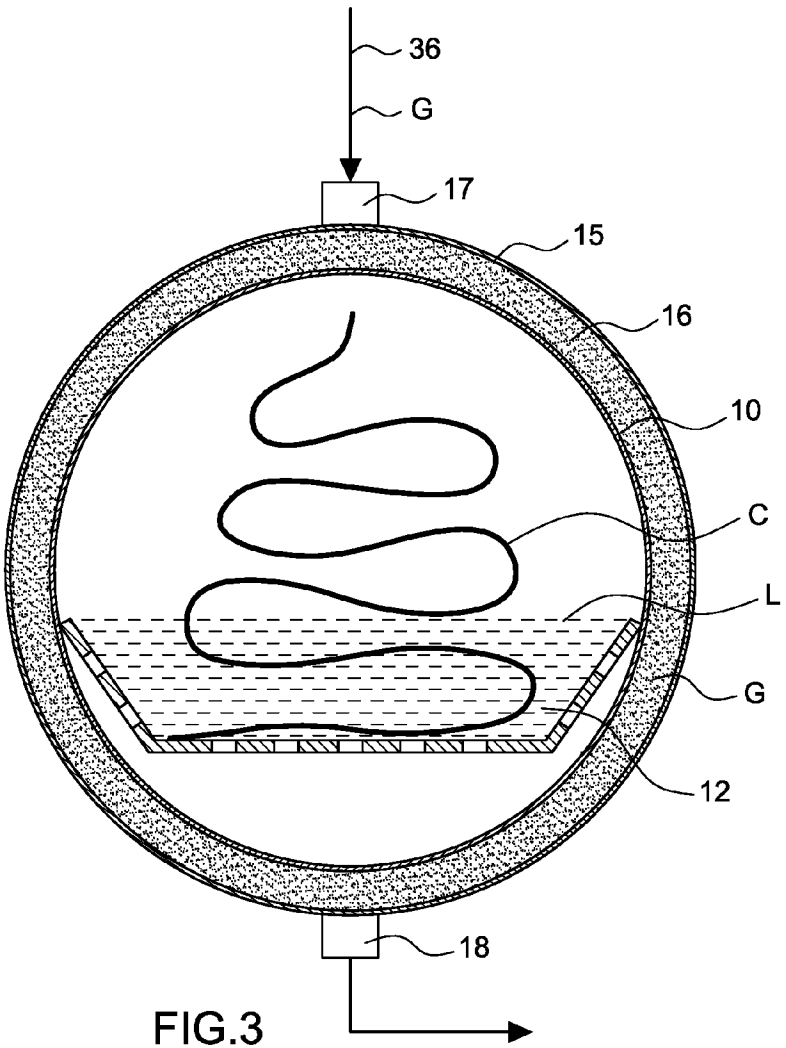
FIG. 3 is a sectional view of a body of the horizontal dyeing machine.

FIG. 3 is a sectional view of the body 10. The storage tank 12 is arranged at a lower position thereof for dipping a piece of fabric C. After being discharged from the direct-heating heat exchanger 31 via the exhaust gas duct 36, the heated exhaust gas G enters the surrounding space 16 via the intake port 17 and reheats the liquid dyes L by another heat exchange process before being discharged from the exit port 18.

Figure 4:
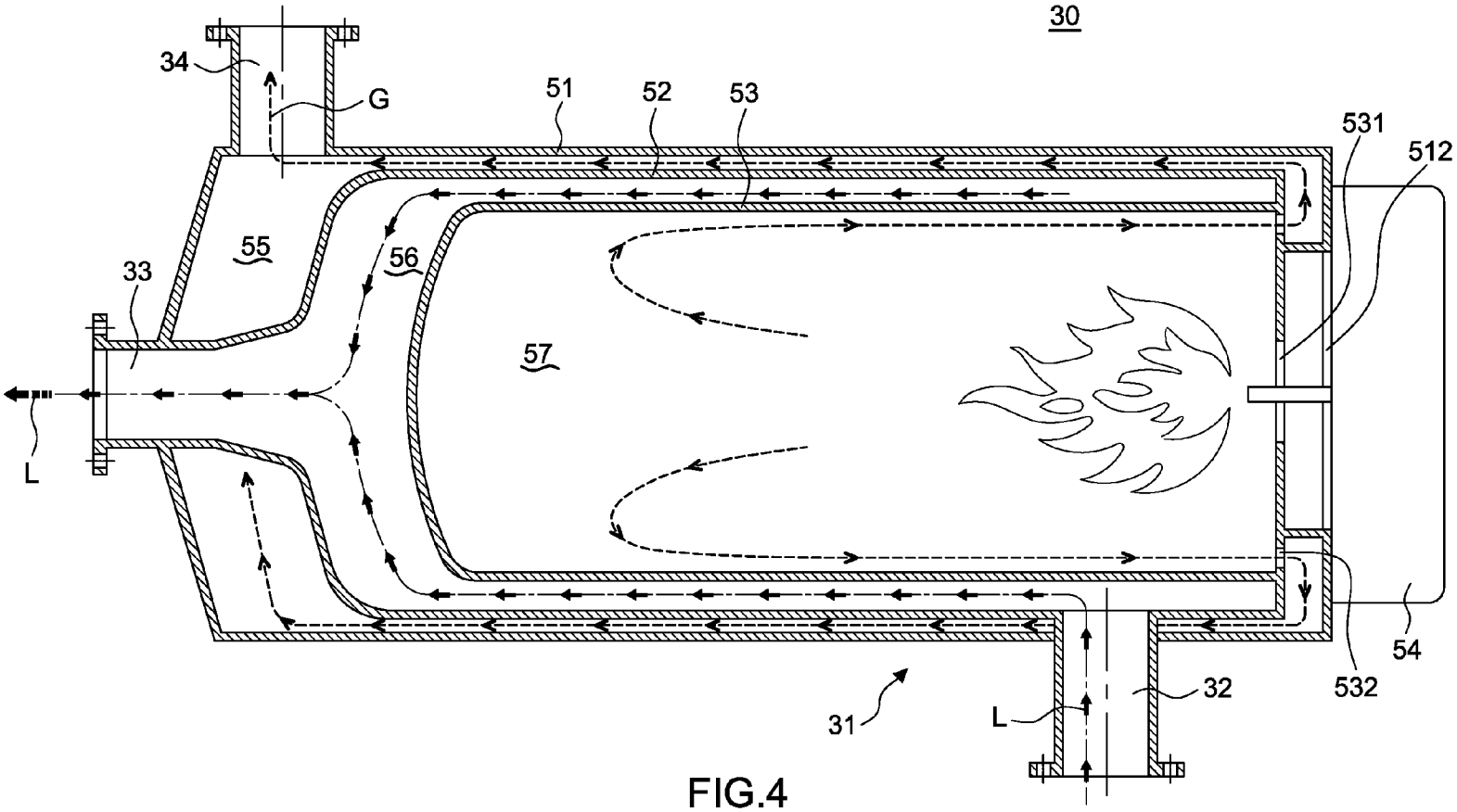
FIG. 4 is a schematic diagram illustrating structures of a direct-heating heat exchanger of the present invention.

Further referring to FIG. 4, the direct-heating heat exchanger 31 includes an inner room 53, an intermediate room 52, an outer room 51, and a heating unit 54. The inner room 53 has a heating room 57 therein and an inner entry 531 arranged aside. The intermediate room 52 is surrounding the inner room 53, defining a heat exchanging room 56 connecting the first entry 32 and the first exit 33. The outer room 51 is surrounding the intermediate room 52, defining a discharging room 55 connecting to the exhaust gas outlet 34. The discharging room further includes a plurality of connecting holes 532 connecting through the heating room 57 and an outer entry 512 arranged corresponding to the inner entry 531. The heating unit 54 is arranged at the outer entry 512 to send fuels into the heating room 57.

Figure 5:
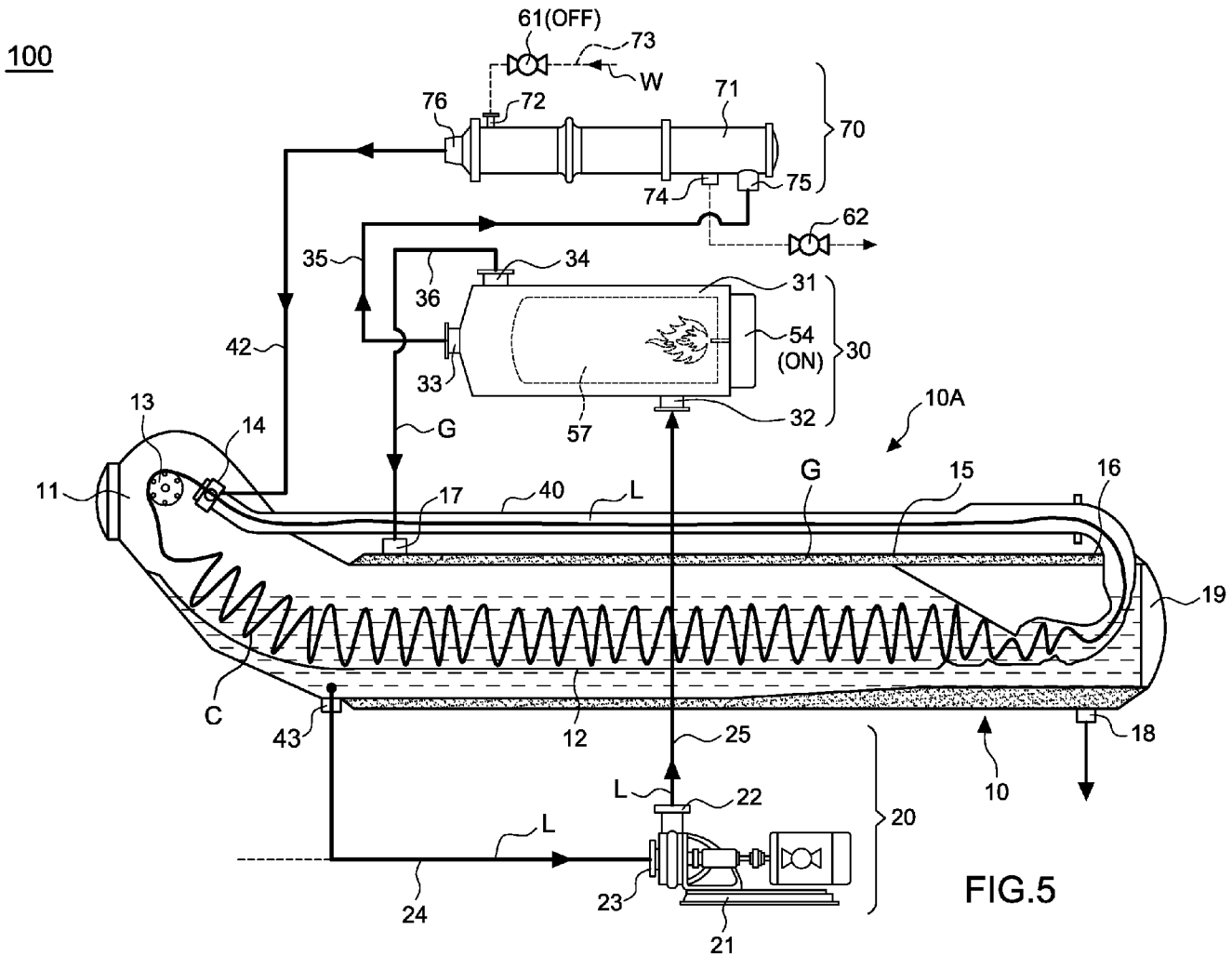
FIG. 5 is a schematic diagram illustrating the horizontal dyeing machine heating up liquid dyes.

FIG. 5 illustrates the operation of the present invention heating up liquid dyes L. When conducting heating, the direct-heating heat exchanger 31 and the heating unit 54 are activated to send the fuels into the heating room 57 to produce heat energy, then the entry valve 61 and the exit valve 62 are closed for liquid dyes L to enter the direct-heating heat exchanger 31 from the liquid dye supply device 20 via the supply tube 25 for heating. After the heating, liquid dyes L flow to the cooling unit 70 via the series connected pipeline 35 and then into the body 10 via the entering tube for liquid dyes 42 and the nozzle 14 to arrive the storage tank 12. The heated exhaust gas G after heat exchanging process with liquid dyes L in the direct-heating heat exchanger 31 then enters the surrounding space 16 via the exhaust gas duct 36 to reheat the liquid dyes L in the body 10.

Figure 6:
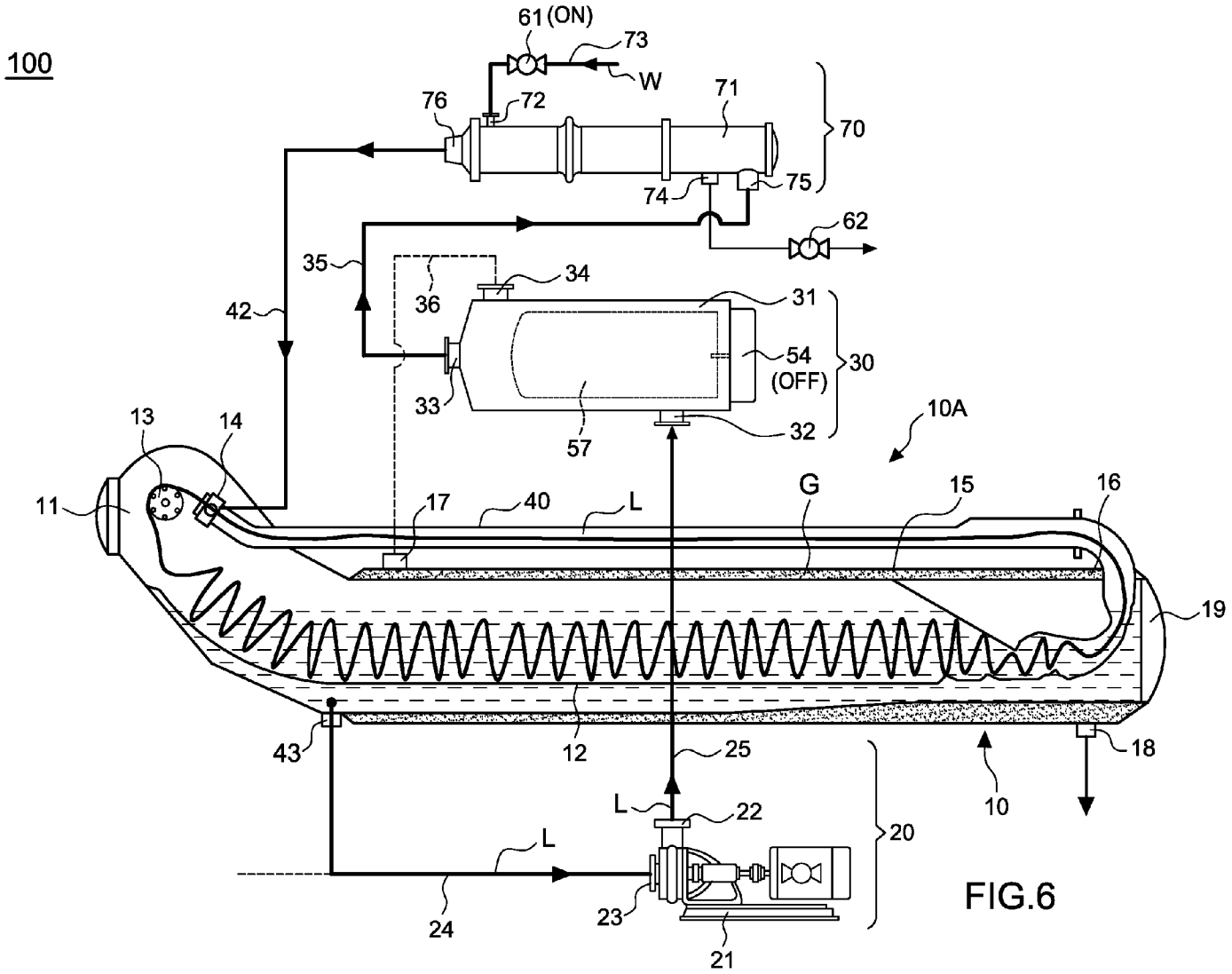
FIG. 6 is a schematic diagram illustrating the horizontal dyeing machine cooling down liquid dyes.

FIG. 6 illustrates the operation of the present invention cooling down liquid dyes L. When conducting cooling, the heat exchanger 71 of the cooling unit 70 is activated, and the entry valve 61 and exit valve 62 are opened for cooled water W to enter the heat exchanger 71 from the cooled water supply tube 73. Then the liquid dyes heating device 30 is closed and liquid dyes L flows through the liquid dye supply device 20 via the supply tube 25 and the liquid dyes heating device 30 to enter the heat exchanger 71 via the series connected pipeline 35 for cooling. After cooling, liquid dyes L flow into the body 10 via the nozzle 14 to arrive the storage tank 12.

In short, the present invention has the direct-heating heat exchanger 31 to heat up liquid dyes L by the heated exhaust gas G, saving several heating procedures and unnecessary energy wastes in a conventional dyeing machine. In addition, the present invention further has the surrounding space 16 formed between the body 10 and the outer wall 15 to reuse the heated exhaust gas G for heating the liquid dyes L in the body 10 for a second time to make a better use of the heat energy.

Although particular embodiment of the invention has been described in detail for purposes of illustration, various modifications and enhancements may be made without departing from the spirit and scope of the invention. Accordingly, the invention is not to be limited except by the appended claims.

What is claimed is:

1. An energy-saving dyeing machine, comprising:

a body having an entering port for liquid dyes arranged aside, connecting to an entering tube, and an exiting port for liquid dyes arranged at the other side, connecting to an exiting tube for liquid dyes circulation;

a liquid dyes supply device arranged outside said body, including a pump for pressuring, an outlet connecting to a supply tube, and an inlet connecting to said exiting tube;

a liquid dyes heating device arranged outside said body near the liquid dyes supply device, including a direct-heating heat exchanger to heat up liquid dyes, said direct-heating heat exchanger including an inner room having a heating room therein and an inner entry arranged aside, an intermediate room surrounding said inner room, defining a heat exchanging room with a first entry connecting to said supply tube and a first exit connecting to a series connected pipeline for discharging heated liquid dyes, an outer room surrounding said intermediate room, defining a discharging room with a exhaust gas outlet and including a plurality of connecting holes connecting through said heating room and an outer entry arranged corresponding to said inner entry, and a heating unit arranged at said outer entry to send in fuels into the heating room; and a cooling unit arranged outside said body near said liquid dyes heating device, including a heat exchanger to cool down liquid dyes, said heat exchanger having an entering port for liquid dyes connecting to an entry valve and a cooled water supply tube, an exiting port for liquid dyes connecting to an exit valve for discharging cooled water, a second entry connecting to said series connected pipeline, and a second exit connecting to said entering tube;

whereby when heating up liquid dyes, the exit valve is closed and liquid dyes enter the direct-heating heat exchanger from the liquid dyes supply device via the supply tube for heating, then flow through the series connected pipeline and the cooling unit without cooling and flow into the body via the entering tube; while cooling down liquid dyes, the exit valve is opened and liquid dyes enter the direct-heating heat exchanger from the liquid dyes supply device via the supply tube without heating, then flow through the series connected pipeline into the heat exchanger for cooling, and flow into the body via the entering tube.

2. The energy-saving dyeing machine as claimed in claim 1, wherein the body includes an outer wall to define a surrounding space for heating, said surrounding space has an intake port arranged aside and an exit port arranged at the other side; and the exhaust gas outlet of the direct-heating heat exchanger has an exhaust gas duct connecting the intake port of the surrounding space thereby the heated exhaust gas is able to enter the surrounding space to heat up liquid dyes in the body for a second time.

3. The energy-saving dyeing machine as claimed in claim 1, wherein the body further includes a head portion with a rolling reel and a nozzle connecting to the entering port for liquid dyes, a storage tank, and a guiding tube linking the nozzle to a rear section of the body for circulation dipping.

* * * * *